United States Patent [19]

Mommsen et al.

[11] Patent Number: 4,497,447

[45] Date of Patent: Feb. 5, 1985

[54] ENERGY DAMPING DEVICE FOR SPRAY GUN

[75] Inventors: Gordon V. Mommsen, Brooklyn Center; Anil Marfatia, Maple Grove, both of Minn.

[73] Assignee: Graco, Inc., Minneapolis, Minn.

[21] Appl. No.: 496,830

[22] Filed: May 23, 1983

[51] Int. Cl.[3] ..... B05B 5/00

[52] U.S. Cl. ..... 239/691; 239/708

[58] Field of Search ..... 239/697, 706, 707, 708, 239/691; 339/9

[56] References Cited

U.S. PATENT DOCUMENTS

| | | | |
|---|---|---|---|
| 340,512 | 4/1886 | Kratz | 339/9.5 X |
| 2,266,532 | 12/1941 | Braunschweig | 339/9 RY |
| 3,014,100 | 12/1961 | Zablocki | 339/9 R |
| 3,248,606 | 4/1966 | Fraser . | |
| 3,292,860 | 12/1966 | Williams et al. | 239/707 X |
| 4,182,490 | 1/1980 | Kennon . | |
| 4,241,880 | 12/1980 | Hastings . | |
| 4,245,784 | 1/1981 | Garcin . | |
| 4,335,851 | 6/1982 | Hastings | 239/3 |

FOREIGN PATENT DOCUMENTS

| | | | |
|---|---|---|---|
| 1125446 | 9/1964 | United Kingdom | 239/697 |

*Primary Examiner*—Andres Kashnikow
*Assistant Examiner*—Kevin Patrick Weldon

[57] ABSTRACT

Apparatus is disclosed for resistively damping capacitively stored energy in electrostatic spray guns, wherein a fluid spray valve incorporates an electrode for carrying high electrostatic voltage, the electrode terminating in the spray valve and the spray valve having a conductor contacting the electrode and extending externally thereof. A resistive element at least partially encloses the spray valve and electrically contacts the conductor, permitting electrical conductivity while also permitting axial sliding movement of the spray valve inside of the resistive element.

5 Claims, 3 Drawing Figures

ENERGY DAMPING DEVICE FOR SPRAY GUN

BACKGROUND OF THE INVENTION

The present invention relates generally to electrostatic spray guns, and more specifically to an improvement for dissipating electrical energy which becomes capacitively stored in the conductive components of electrostatic spray guns. The invention is an improvement in the design of such spray guns wherein a fluid spray valve serves the dual function of controlling fluid flow through a fluid ejection orifice at the forward end of a spray gun as well as carrying the electrically conductive path which terminates in an electrode projecting through the fluid ejection orifice.

Fluid spray valves incorporating an electrostatic electrode are known in the art. An example of an electrostatic spray gun having such a construction is shown in U.S. Pat. No. 3,583,632, issued June 8, 1971, wherein an axially movable spray valve carries an electrostatic electrode projecting through a fluid ejection orifice. The spray gun disclosed in this prior art patent has an electrical resistor incorporated into the body of the spray gun for damping capacitively stored electrical energy, but such resistor is located at a significant distance from the forwardly projecting electrode. The electrically conductive components between the resistor of the spray gun and the electrode are capable of storing a significant amount of capacitive energy, and if such energy is dissipated in the form of a spark in an explosive atmosphere, it can cause fire or explosion to result.

The placement of a smaller resistor at a position which is physically closer to the electrode is shown in U.S. Pat. No. 4,241,880, issued Dec. 30, 1980, wherein the smaller resistor is contained within the fluid spray valve, and is electrically connected to the projecting electrode. A resistor in this position dampens the capacitively stored energy which may be stored in the conductive components upstream of the resistor. The forward resistor is embedded in the fluid flow valve itself, and therefore is axially movable with the fluid flow valve as it is engaged by a trigger to permit the ejection of fluids from the fluid ejection orifice.

The same concept is taught in U.S. Pat. No. 3,233,831, issued Feb. 8, 1966 wherein the fluid spray valve itself may be made of resistive material, and also serves as the electrode, to provide the necessary resistive damping of capacitively stored energy to the forwardmost electrical point of the spray gun. Similarly, this patent discloses an axially slidable fluid spray valve, wherein the resistive component moves in coincidence with the spray valve.

The small, forwardmost resistors disclosed in the foregoing patents either form a part of the fluid spray valve or are contained therein, and thus necessarily must be constructed of small physical size to meet the design requirements of the spray valve. In the case of the '880 patent, the resistor must be constructed of very small phyical size so as to be capable of being embedded directly within the spray valve. The heat generated by current flow through this very small resistor is dissipated only by passing through the outer spray valve casing, thereby creating heat and electrical stress within the resistor. Further, since the spray valve itself is a component which is subject to considerable wear during the course of the spray gun operation, it is frequently manufactured as a replaceable component. Because the resistor is physically enclosed within the spray valve, replacement of the spray valve due to mechanical wear in use necessitates replacement of the resistor as well. It is therefore desirable to provide the requisite resistive component proximate the forward end of the spray gun, without also requiring that it be discarded as a part of the fluid spray valve whenever physical wear of the spray valve necessitates replacement. Further, it is desirable to construct the forwardmost resistor physically as large as possible in order to improve heat dissipation.

SUMMARY OF THE INVENTION

The present invention utilizes a tubular resistor which is axially mounted in the forwardmost fluid passage of a spray gun, and which at least partially surrounds a fluid spray valve which is axially slidable therein. The fluid spray valve engages in fluid sealing relationship against the fluid ejection orifice, and holds a forwardly projecting electrode which projects through the fluid ejection orifice. A conductor in the fluid spray valve electrically contacts the forwardly projecting electrode, and projects externally of the fluid spray valve to slidingly engage against the inner surface of the tubular resistor. Axial movement of the fluid spray valve provides continual electrical continuity through the tubular resistor, the slidable electrical conductor, and the forwardly projecting electrode.

It is therefore a principal object of the present invention to provide a fluid spray valve in an electrostatic spray gun which carries a forwardly projecting electrode and electrically contacts a resistor placed proximate the forward end of the spray gun.

It is another object of the present invention to provide a forwardly placed secondary resistor which has good heat dissipation characteristics.

It is another object of the present invention to provide a forwardly placed resistor in a spray gun which is not physically incorporated into a fluid spray valve, and it is therefore not subject to replacement when spray valve wear requires that valve parts be replaced.

BRIEF DESCRIPTION OF THE DRAWINGS

The foregoing and other objects and advantages of the invention will become apparent from the following specification, and with reference to the appended drawings, in which.

DESCRIPTION OF THE PREFERRED EMBODIMENT

Figure 1:
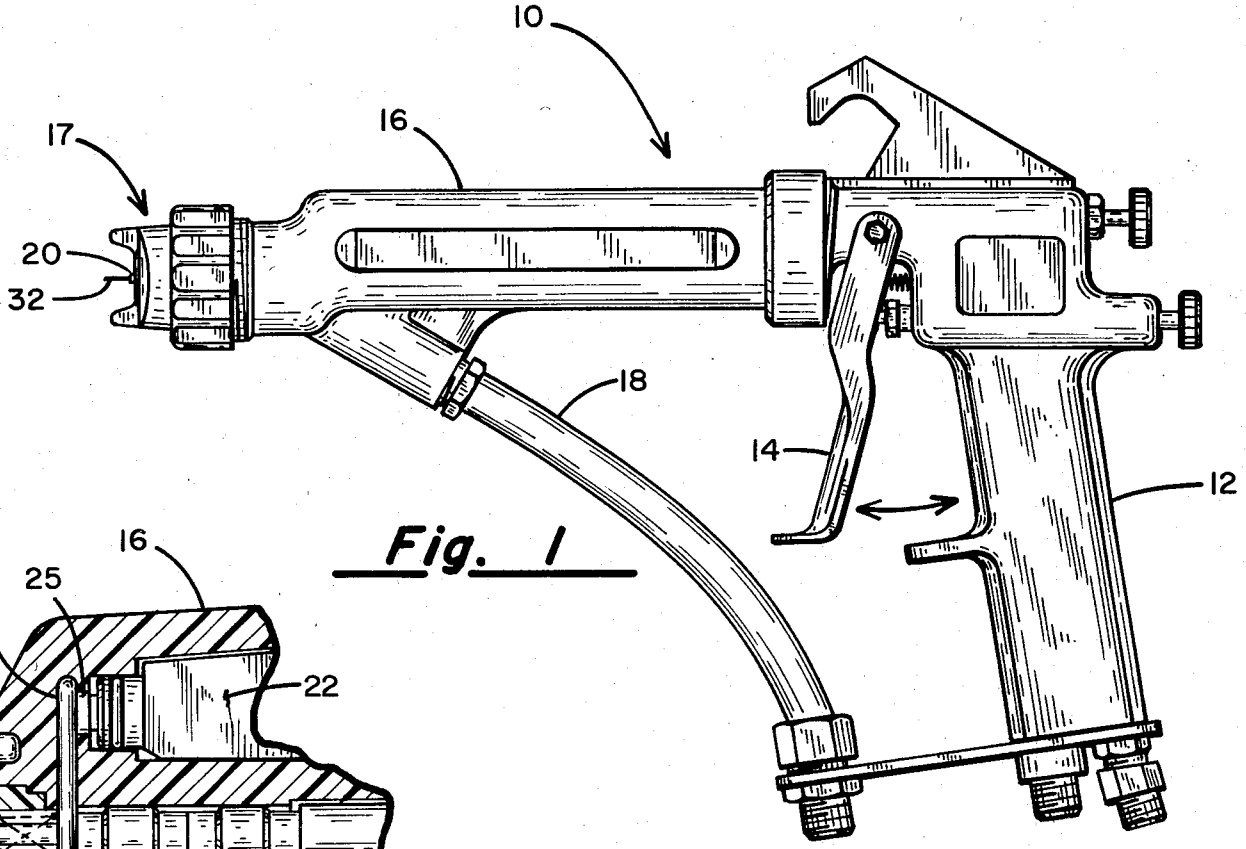
FIG. 1 shows a spray gun in side view.

Referring first to FIG. 1, there is shown an electrostatic spray gun 10 of a type generally known in the prior art. Spray gun 10 has a handle 12 which is adapted for gripping by a user, and a trigger 14 which may be squeezed to actuate the fluid spray valve, and activate the electrical components therein. Spray gun 10 has a barrel 16 which has passages therethrough for containment of the required electrical components, and has passages for containment of the fluid being sprayed. Barrel 16 may also have passages for directing compressed air to various points proximate the front end of the spray gun. These air passages typically terminate at a nozzle 17 through which a fluid ejection orifice 20 also projects. A fluid passage 18 is adapted for connection to a source of fluid to be sprayed, and directs the fluid into the region of the nozzle.

Figure 2:
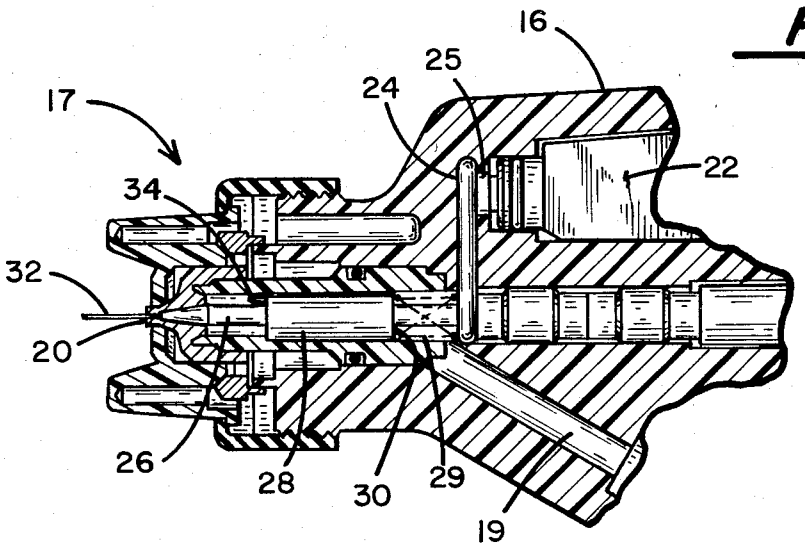
FIG. 2 shows a cross section view of a portion of the spray gun of FIG. 1.

The front portion of spray gun 10 is shown in cross sectional view in FIG. 2, to illustrate the significant features and advantages of the present invention. A large electrical resistor 22 is enclosed in a passage of barrel 16, and terminates at a point proximate the spray gun nozzle 17. Resistor 22 is typically of large resistive magnitude, and may be in the range of 100–200 megohms, or more. A conductive member 24 is electrically coupled to the forward end of resistor 22, and provides a path for electrical current to the region of axial fluid flow passage 30. A compression spring 29 contacts conductive member 24, and a smaller tubular resistor 28 electrically contacts compression spring 29. Tubular resistor 28 at least partially surrounds fluid valve 26. Fluid valve 26 projects axially in flow passage 30, and terminates in a tapered valve portion. The tapered valve portion engages against a seat, which combination provides fluid sealing with respect to fluid ejection orifice 20. Fluid valve 26 is axially movable in passage 30 by connection to trigger 14 in a conventional manner.

Figure 3:
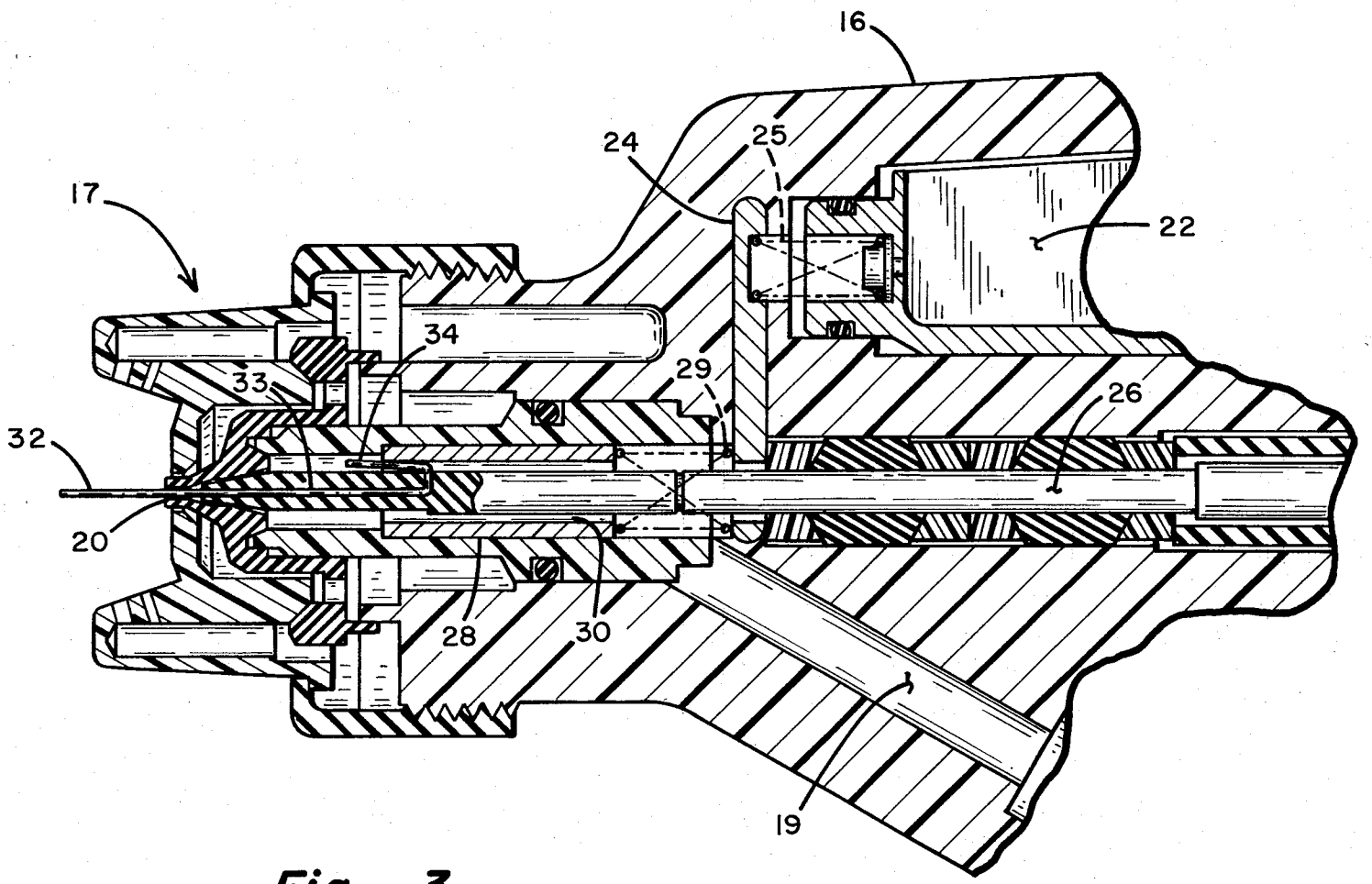
FIG. 3 shows a further cross sectional view.

Referring next to FIG. 3, a portion of the barrel 16 and nozzle 17 of spray gun 10 are shown in expanded and cross sectional view. Nozzle 17 includes a number of air passages which are used to direct pressurized air upon the fluid emitted from fluid ejection orifice 20, and are otherwise beyond the scope of the present invention. Fluid passage 18 extends into the barrel 16, and a further fluid passage 19 is connected into flow coupling relationship with axial fluid flow passage 30. Fluid passage 30 terminates at fluid ejection orifice 20. Fluid valve 26 is axially aligned in fluid passage 30, its forward end being formed into mating engagement with the forward end of fluid passage 30. Fluid valve 26 extends rearwardly into mechanical linkage with trigger 14, or alternatively may be segmented into several parts, including a nonconductive valve rod portion which is mechanically coupled to trigger 14. Fluid valve 26 has embedded therein an electrode 33, which electrode projects forwardly through fluid ejection orifice 20 at segment 32.

A large resistor 22 is contained within barrel 16, and terminates at a forward end which is in electrical contact with a conductive member 24. Conductive member 24 may be formed of conductive plastic or other similar material, or may be made from a conventional metallic conductor. Conductive member 24 is in electrical contact against a compressing spring 29 which extends forwardly to contact the outer surface of tubular resistor 28. Tubular resistor 28 is axially aligned in passage 30, and has an inner diameter which slidably accepts fluid valve 26.

The electrical connection between conductive member 24 and electrode 33 is shown in greater detail with reference to FIG. 3. Electrode 33, at segment 32, projects forwardly of fluid ejection orifice 20, and extends rearwardly into fluid valve 26. Electrode 33 is joined to segment 34, which preferably overlays a portion of the external surface of fluid valve 26. Segment 34 is in electrical contact with the inner circumferential surface of tubular resistor 28, and is slidable therein with fluid valve 26. The region of electrical contact between segment 34 and tubular resistor 28 is preferably formed at or near the forward end of the tubular resistor 28.

In operation, actuation of the spray gun trigger will cause fluid valve 26 to axially move into and out of seating engagement against the forward end of fluid passage 30. In its forwardmost position fluid valve 26 is adapted for fluid sealing engagement against the tapered forward wall of fluid passage 30, and in its rearward position fluid valve 26 unseats the passage opening and permits the flow of fluid therethrough. In either position, electrode segment 34 retains good electrical contact against the inner surface of tubular resistor 28, thereby providing electrical continuity to electrode segment 32. The spray gun trigger may also be adapted for activation of the electrical circuits associated with the spray gun so as to provide an electrical path through the components herein described whenever the trigger is actuated, and to electrically energize electrode segment 32 upon actuation of spray valve 26. Tubular resistor 28 may be axially positioned along passage 30 at any convenient location, and may be positioned forwardly of the entrance point of passage 19. If tubular resistor 28 is forwardly positioned, fluid flow channels may be cut along the inner or outer circumferential surface of tubular resistor 28 to accommodate the flow of fluid. Alternatively, fluid valve 26 may have a noncircular cross section, at least in the region which passes through tubular resistor 28, to better facilitate the flow of fluid.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In an electrostatic spray gun of the type having fluid passages therein for the passage of fluid therethrough, and having passages therethrough for containing electrically conductive components for carrying a voltage to a forwardly projecting electrode, the electrode and the forwardmost fluid passage being in axial alignment, the improvement comprising (a) a fluid ejection orifice proximate the forward end of said forwardmost fluid passage;

(b) a fluid valve adapted for seating in fluid sealing relationship in said fluid ejection orifice;

(c) a conductor in said fluid valve, said conductor having a segment projecting forwardly through said fluid ejection orifice to form said forwardly projecting electrode, and said conductor having a further segment projecting externally of said fluid valve into said forwardmost fluid passage;

(d) a resistive element in said forwardmost fluid passage, said resistive element having an axial opening therethrough sized to permit axial movement of said fluid valve therein, said further segment of said conductor in said fluid valve being in electrical contact against said resistive element;

(e) means for electrically connecting said resistive element to further electrically conductive components in said spray gun passages;

(f) means for coupling said forwardmost fluid passage to further fluid passages in said spray gun; and (g) means for axially moving said fluid valve in opening and closing relationship to said fluid flow.

2. The apparatus of claim 1, wherein said resistive element further comprises a tubular resistor axially aligned in said fluid passage.

3. The apparatus of claim 2, wherein said fluid valve further comprises axially elongated surfaces adapted for sliding engagement against an inner surface of said tubular resistor.

4. The apparatus of claim 3 wherein said fluid valve conductor segment further comprises a segment along said fluid valve axially elongated surface.

5. The apparatus of claim 4, wherein said means for electrically connecting said resistive element further comprises a compression spring.

* * * * *